US007174580B1

(12) United States Patent
Papierniak

(10) Patent No.: US 7,174,580 B1
(45) Date of Patent: Feb. 13, 2007

(54) TUB/SHOWER INSTALLATION BLOCK

(76) Inventor: Jon Papierniak, P.O. Box 219, Thorp, WI (US) 54771

( * ) Notice: Subject to any disclaimer, the term of this patent is extended or adjusted under 35 U.S.C. 154(b) by 283 days.

(21) Appl. No.: 10/971,957

(22) Filed: Oct. 25, 2004

(51) Int. Cl.
*E03C 1/042* (2006.01)

(52) U.S. Cl. ..... 4/695

(58) Field of Classification Search ..... 4/695; 285/64; 248/56, 57
See application file for complete search history.

(56) References Cited

U.S. PATENT DOCUMENTS 5,418,986 A * 5/1995 Warkus et al. ..... 4/695
6,360,381 B1 * 3/2002 Fitzgerald, Sr. ..... 4/695

* cited by examiner

*Primary Examiner*—Tuan Nguyen
(74) *Attorney, Agent, or Firm*—Robert O. Wright

(57) ABSTRACT

An adjustable mounting block for use in positioning tub/shower control units in a tub/shower enclosure is disclosed. A self adhesive adjustable height block may be used to position a control unit in an enclosure opening from the back side by a sole installer who can then finish the installation from the finished side subsequently without unwanted movement.

11 Claims, 2 Drawing Sheets

TUB/SHOWER INSTALLATION BLOCK

This invention relates to installation supports for tub and/or shower enclosures and the proper and secure installation therein of desired plumbing fixtures. More particularly this invention relates to mounting blocks for positioning and securing faucet sets, tub spouts and shower heads in proper operational position in prefabricated tub and shower enclosures such as those currently made from fiber glass reinforced resins and the like.

PRIOR ART

In the plumbing art various fixtures for positioning and mounting faucets sets and other devices have consisted of brackets, frames, and the like which are generally fixed to the building framing, such as the studs, forming the walls of the bathroom in which the fixtures are to be installed. As more complete off site manufactured tub and shower enclosures have become popular it has not always been convenient or easy to install the water controls in the desired location in the prefab enclosure relative to the building structure. These prior art mounting devices have been complicated, expensive to manufacture and difficult or time consuming to use and often requiring an assistant.

OBJECTS OF INVENTION

Accordingly it is an object of the present invention to provide a universal mounting block for positioning and securing plumbing fixtures in the desired location in a bathroom.

It is another object of the present invention to provide a universal mounting block for mounting plumbing fixtures that is simple to use, economical to manufacture, and readily adaptable to a variety of installation situations.

It is a still further object of the present invention to provide a mounting block that can be simply and easily used by one person to accurately position and secure faucets, spouts and shower heads in wall enclosures without attachment to other wall structure.

It is yet another object of the present invention to provide mounting means for positioning objects relative to a surface that is simple and easy to manufacture and use and readily adjustable to a variety of applications.

These and other and further objects of the present invention are obtained in one embodiment in which a support block includes a base member, having a self adhesive on the bottom thereof, carries an adjustable telescoping mounting block therein which is selectively secured to a pipe by a suitable arcuate strap and adjustably positioned relative to said base member by a pair of adjusting screws.

DESCRIPTION OF PREFERRED EMBODIMENTS

Figure 1:
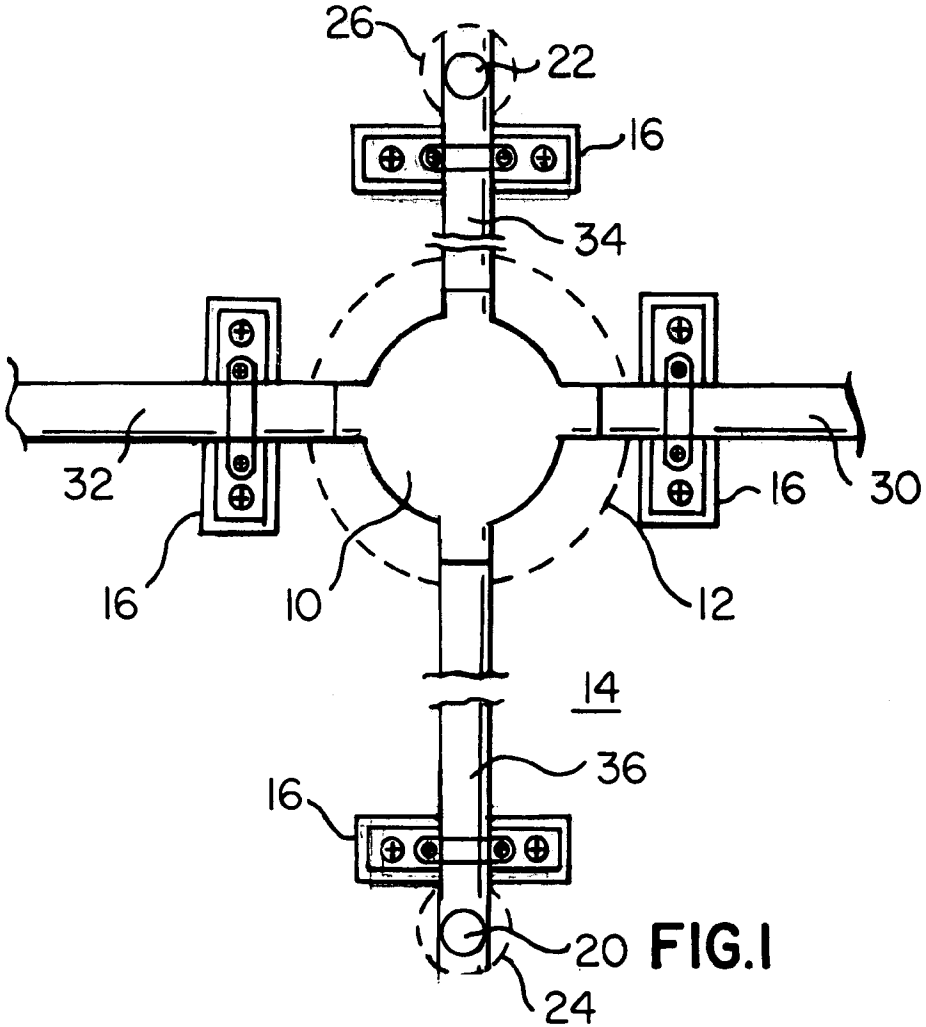
FIG. 1 is an elevational plan view taken from the back side of an installation, of the blocks of the present invention used to mount a single handle tub/shower valve assembly.

Referring now to FIG. 1 there is shown, from the back side, a single handle tub/shower valve 10 mounted so that the handle extends through a hole 12 cut in the tub/shower wall 14 by two blocks 16 according to the present invention. Third and fourth blocks 16 are shown adjacent the tub spout pipe 20 and the shower head pipe 22 respectively. The blocks 16 have a self adhesive layer 18 on the bottom (see FIGS. 3 & 4) which allows the blocks to adhere to the back surface of the tub enclosure 14. The blocks are placed adjacent the hole 12 and holes 24 and 26 so as to support the valve, tub spout, and shower head respectively. The left and right hand blocks 16 carry thereon the hot and cold water pipes 30 and 32 while the upper and lower blocks 16 carry the shower and tub supply lines 34 and 36.

Figure 3:
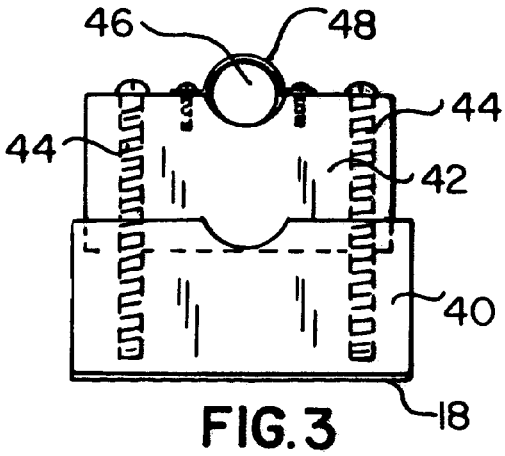
FIG. 3 is a side elevation of one of the blocks of FIG. 1 shown in fully extended position.
Figure 4:
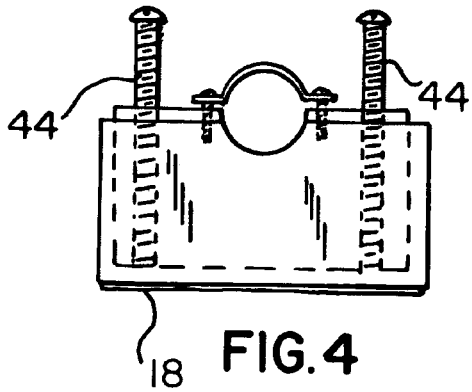
FIG. 4 is a view similar to FIG. 3 shown in the closed position.
Figure 5:
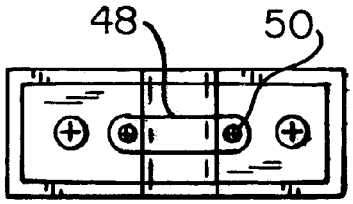
FIG. 5 is a top plan view of the block of FIG. 3.

As may be seen more clearly in FIGS. 3–5 the blocks 16 include a base member 40 and a telescoping body member 42 that is moved in and out of base member 40 by two screws 44. Base member 40 has in the upper surface a half circle groove 41 to fit a pipe to be supported such as 46. Body member 42 has in the upper surface a similar half circle groove 43 sized to fit the pipe 46 to be supported. A semicircular strap 48 is secured about the pipe to be supported to body member 42 by screws 50.

Figure 2:
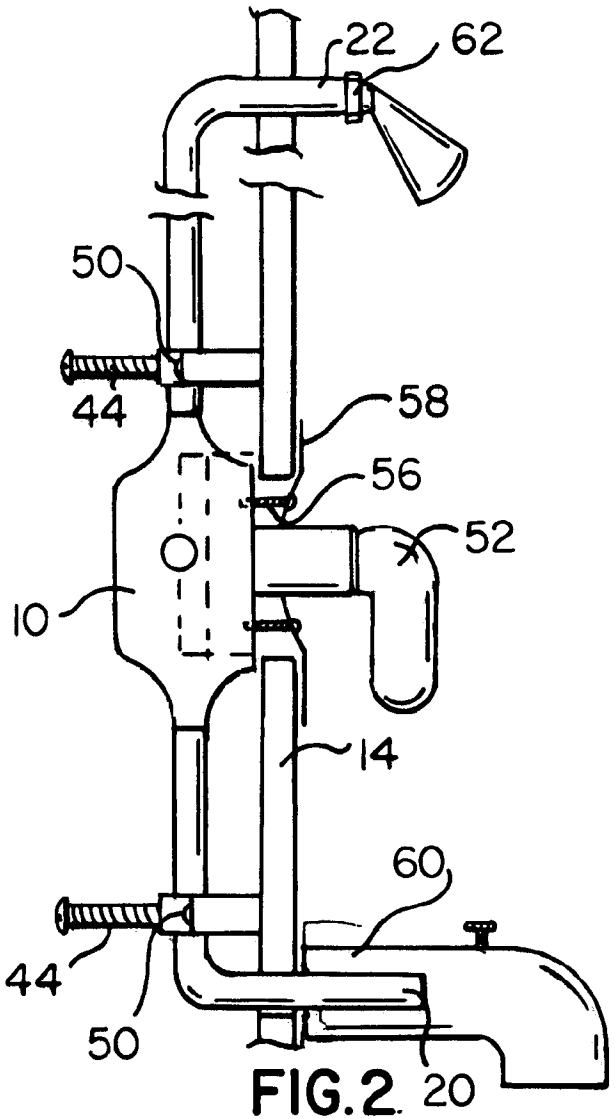
FIG. 2 is a side elevation taken on line 2—2 of the of the apparatus of FIG. 1.

As may be seen in FIG. 2 the screws 44 are adjusted to space the pipes 30. 32, 34, and 36 from the tub wall 14 the desired distance so as to position the handle 52 the desired distance into the shower enclosure. The blocks 16 are shown with body members 42 essentially fully retracted into the base members 40 but in other cases the spacing required may be greater in which case the body member 42 will be extended the desired distance up to the maximum as shown in FIG. 3 by the turning of screws 44.

In addition to the self adhesive 18 on the bottom of the blocks 16 the valve assembly 10 in a typical installation will be clamped to the wall 14 in the hole 12 by the mounting screws 56 used to fasten the interior finish escutcheon or ring 58 to the valve body 10. The blocks 16, however, ensure that there will be no play or other movement of the valve assembly 10 relative to the tub or shower enclosure especially during the installation process.

In actual use the blocks 16 will first be clamped on to the hot and cold water supply pipes and also the tub/shower pipes in the desired locations adjacent the faucet valve being used as described in connection with FIGS. 3–5. The usual protective masking tape is removed from the self adhesive coating on the bottom of blocks 16 and the pipe and valve assembly is then centered in the previously cut holes in the tub/shower enclosure. The self adhesive coated blocks 16 will hold the assembly in the selected location which allows the plumber to attach the interior finish hardware such as the escutcheon 58, tub spout 60 and shower head 62 to securely lock the assembly in place without the need of a helper.

If during this installation it is noted that the valve 10 or the tub/shower pipes extend too far into the interior of the tub/shower enclosure simple adjustment of the screws 44 of the blocks 16 will correct the situation.

While I have shown and described the universal blocks as being used with a single handle valve assembly for tub/shower application they are equally useful with dual or multiple handle tub/shower faucet valve assemblies and shower only installations.

In the examples shown in FIGS. 1–5 the blocks 6 have an overall length of approximately four inches; a closed height of about two inches and a depth of approximately one and one-half inches. Obviously other specific dimensions may be employed for particular applications.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

I claim:

1. A universal mounting block for positioning water supply pipes and controls in tub/shower enclosures which comprises in combination:

a rectangular, substantially hollow base member having a closed bottom and an open top;

a semicircular groove formed in the upper side edges of said base member to selectively receive therein a portion of a water pipe;

a rectangular body member telescopically mounted in said base member and having in the outer surface thereof a semicircular groove congruent with said semicircular groove in said base member when said body member is fully telescoped within said body member to receive a portion of a water pipe positioned in said base member;

an elevating screw assembly operatively positioned in said base member and threaded in said body member on each side of said semicircular groove to locate said body member in said base member;

a convex strap member mounted on said body member across said semicircular groove to form a circular pipe receiving orifice with said grooves in said body and base members;

screw means in each end of said strap member for selectively securing said strap member to the top of said body member; and a layer of self adhesive material on the bottom outer surface of said base member for mounting said universal mounting block member on a surface;

whereby a water pipe positioned in said circular pipe receiving orifice may be mounted a preselected spaced distance from a wall surface.

2. A universal mounting block as claimed in claim 1 wherein said elevating screw assemblies in either end of said body member are rotatably engaged with said base member to telescopically secure said body member within said base member.

3. A universal mounting block as claimed in claim 2 wherein said base member and body member are made of a generally non compressible plastic material and have a telescopic dimension range of one inch to two inches.

4. A universal mounting block for selectively positioning objects relative to a surface which comprises:

a base member having inner and outer bottom surfaces;

self adhesive means formed on the outer bottom surface of said base member;

a body member having an inner bottom and an outer top surface adjustably mounted on said base member for selective movement toward and away from said inner bottom surface of said base member; and a strap member adjustably positioned on the outer top surface of said body member to form an object receiving aperture with said outer body member surface;

whereby an object may be positioned adjacent to a surface a selected distance therefrom by insertion into said strap member object receiving aperture and adhering said base member self adhesive outer bottom surface to said surface.

5. A universal mounting block as claimed in claim 4 further including screw jack means operatively positioning said body member relative to said base member.

6. A universal mounting block as claimed in claim 4 wherein said base member is generally rectangular with an open top and said body member is similarly shaped and telescopes within said base member.

7. A universal mounting block as claimed in claim 6 wherein said base and body members have matching concave grooves in their outer surfaces positioned to cooperate with said strap member to form said object receiving aperture.

8. The method of positioning a device having a plurality of peripheral elements extending outwardly therefrom in an opening of a structure surface having a finished surface and an unfinished back surface which comprises;

forming a plurality of mounting blocks each having bottom and top surfaces;

applying a self adhesive material to the bottom surface of said mounting blocks;

securing a plurality of said mounting blocks at the top surfaces thereof to the peripheral elements of the device to be positioned;

orienting all of said mounting blocks with the self adhesive surface facing the back side of said structure surface;

positioning said device in a desired orientation in said opening of a structure surface from the unfinished back surface side of said structure surface, with at least one peripheral element of said device extending through said structure opening;

causing said mounting block self adhesive surfaces to adhere to said unfinished back side structure surface;

positioning a decorative finishing member having a size greater than said opening of said structure on said structure finished surface about said structure opening and said at least one peripheral element; and securing said decorative finishing element to said device to clamp said device securely to said structure surface a desired spaced distance from the back side of said structure surface in said previously desired orientation within said structure opening;

whereby said device may be mounted in said structure surface by one person working alone first on the back unfinished side and then on the finished surface side of the said structure.

9. The method as claimed in claim 8 wherein said device is a tub/shower water control unit, said structure is a tub/shower enclosure and said peripheral elements are pipes and control handle.

10. The method as claimed in claim 8 wherein said device is a shower control unit having hot and cold supply pipes and a shower head pipe connected thereto.

11. The method as claimed in claim 8 further including:

forming said plurality of mounting blocks each having bottom and top surfaces with means for adjusting the spacing between said bottom and top surfaces;

varying the spacing between said bottom and top surfaces of said plurality of mounting blocks secured at the top surfaces thereof to the peripheral elements of the device to be positioned, in accordance with the dimensions of said device to be installed and the dimensions of said structure surface in which it is to be installed;

whereby devices of various dimensions may be installed in structures of various dimensions to meet previously determined specifications.

* * * * *